US012065616B2

(12) United States Patent
Uppili et al.

(10) Patent No.: US 12,065,616 B2
(45) Date of Patent: Aug. 20, 2024

(54) LIGHT OLEFIN RECOVERY FROM PLASTIC WASTE PYROLYSIS

(71) Applicant: ExxonMobil Chemical Patents Inc., Baytown, TX (US)

(72) Inventors: Sundararajan Uppili, Jersey Village, TX (US); Bryan A. Patel, Jersey City, NJ (US); Randolph J. Smiley, Hellertown, NJ (US); Lawrence R. Gros, Katy, TX (US); Anthony Go, Houston, TX (US); Saurabh S. Maduskar, Houston, TX (US); Melissa D. Foster, Humble, TX (US); Philippe Laurent, Houston, TX (US)

(73) Assignee: ExxonMobil Chemical Patents Inc., Baytown, TX (US)

( * ) Notice: Subject to any disclaimer, the term of this patent is extended or adjusted under 35 U.S.C. 154(b) by 304 days.

(21) Appl. No.: 17/595,344

(22) PCT Filed: Jun. 12, 2020

(86) PCT No.: PCT/US2020/037377
§ 371 (c)(1),
(2) Date: Nov. 15, 2021

(87) PCT Pub. No.: WO2020/252228
PCT Pub. Date: Dec. 17, 2020

(65) Prior Publication Data

US 2022/0195309 A1 Jun. 23, 2022

Related U.S. Application Data

(60) Provisional application No. 62/861,166, filed on Jun. 13, 2019.

(51) Int. Cl.
*C10G 1/10* (2006.01)
*C10B 49/22* (2006.01)
(Continued)

(52) U.S. Cl.
CPC ..... *C10G 1/10* (2013.01); *C10B 49/22* (2013.01); *C10B 53/07* (2013.01); *C10G 9/36* (2013.01)

(58) Field of Classification Search
CPC . C10G 1/002; C10G 1/10; C10G 9/36; C10G 2300/1003; C10B 49/22; C10B 53/07; C10B 57/06
See application file for complete search history.

(56) References Cited

U.S. PATENT DOCUMENTS 5,326,919 A 7/1994 Paisley et al.
9,212,318 B2 12/2015 Narayanaswamy et al.
(Continued)

FOREIGN PATENT DOCUMENTS

WO WO 2012/099677 A2 7/2012

OTHER PUBLICATIONS

Simon et al., Pyrolysis of polyolefins with steam to yield olefins, Journal of Analytical and Applied Pyrolysis, 38, pp. 75-87 (1996).

*Primary Examiner* — In Suk C Bullock
*Assistant Examiner* — Jason Y Chong

(57) ABSTRACT

Systems and methods are provided for integration of a reactor for polyolefin pyrolysis with the effluent processing train for a steam cracker. The polyolefins can correspond to, for example, polyolefins in plastic waste. Integrating a process for polyolefin pyrolysis with a steam cracker processing train can allow a mixture of polymers to be converted to monomer units while reducing or minimizing costs and/or equipment footprint. This can allow for direct conversion of polyolefins to the light olefin monomers in high yield while significantly lowering capital and energy usage due to integration with a steam cracking process train. The integration can be enabled in part by selecting feeds with appropriate mixtures of various polymer types and/or by limiting the volume of the plastic waste pyrolysis product
(Continued)

relative to the volume from the steam cracker(s) in the steam cracking process train. By selecting plastic waste and/or other polyolefin sources with an appropriate mixture of polyolefins as the feedstock, the resulting polyolefin pyrolysis product can be separated in a steam cracking process train to produce separate fractions for various polymer grade small olefin products.

22 Claims, 4 Drawing Sheets

(51) Int. Cl.
*C10B 53/07* (2006.01)
*C10G 9/36* (2006.01)

(56) References Cited

U.S. PATENT DOCUMENTS

| | | | | |
|---|---|---|---|---|
| 2005/0150817 | A1 | 7/2005 | Tallman et al. | |
| 2014/0303339 | A1* | 10/2014 | Keusenkothen | C10G 9/38 422/600 |
| 2019/0177626 | A1 | 6/2019 | Ramamurthy et al. | |
| 2022/0340820 | A1* | 10/2022 | Abbott | C10G 1/086 |

* cited by examiner

LIGHT OLEFIN RECOVERY FROM PLASTIC WASTE PYROLYSIS

CROSS-REFERENCE TO RELATED APPLICATIONS

This application is a National Phase application claiming priority to PCT application Serial No. PCT/US2020/037377, filed Jun. 12, 2020, which claims the priority benefit of U.S. Ser. No. 62/861,166, filed Jun. 13, 2019, the disclosure of which is are incorporated herein by reference in their entirety.

FIELD

Systems and methods are provided for recovery of light olefins produced from plastic waste pyrolysis.

BACKGROUND

Recycling of plastic waste is a subject of increasing importance. Conventionally, polyolefins in plastic waste are converted by various methods, such as pyrolysis or gasification, to produce energy. While this provides a pathway for using waste plastic a second time, ultimately methods for generation of energy from plastic waste also result in conversion of the plastic waste into $CO_2$. To make the process fully circular, so that the polymers can be recycled for return to the same usage, these pyrolysis and gasification products need to go through further pyrolysis or conversion processes to return them back to the light olefin monomer. The olefin monomers can then be repolymerized back to the polyolefin for use in the same service. Unfortunately, this process to make light olefins is high in energy usage, capital required, and produces relatively low yields of the light olefin monomers.

It would be desirable to develop systems and methods that can allow for a circular recycle path for polyolefins with improved olefins yields and/or reduced energy usage. In particular, it would be desirable to develop systems and methods that can allow for recovery of individual monomers from plastic waste that corresponds to a mixture of polymers.

U.S. Pat. No. 5,326,919 describes methods for monomer recovery from polymeric materials. The polymer is pyrolyzed by heating the polymer at a rate of 500° C. per second in a flow-through reactor in the presence of a heat transfer material, such as sand. Cyclone separators are used for separation of fluid products from solids generated during the pyrolysis. However, the resulting vapor phase monomer product corresponds to a mixture of olefins, and therefore is not suitable for synthesis of new polymers.

U.S. Pat. No. 9,212,318 describes a catalyst system for pyrolysis of plastics to form olefins and aromatics. The catalyst system includes a combination of an FCC catalyst and a ZSM-5 catalyst.

SUMMARY

In various aspects, a method for pyrolyzing a mixed polyolefin feed is provided. The method includes exposing a feedstock including a mixture of polyolefins to polyolefin pyrolysis conditions to form a pyrolysis effluent. The mixture of polyolefins can include two or more types of monomers. The polyolefin pyrolysis conditions can include heating the feedstock at a rate of 100° C. per second or more to form a heated reaction mixture having a temperature of 500° C. to 900° C. The polyolefin pyrolysis conditions can further include cooling the heated reaction mixture to a temperature of less than 500° C. to form the pyrolysis effluent, so that the heated reaction mixture is at a temperature of 500° C. or more for 0.1 seconds to 5.0 seconds. After pyrolysis, an initial separation can be performed on the pyrolysis effluent to form at least a pyrolysis product fraction and a fraction comprising solid particles. In addition to the pyrolysis of the polyolefin feedstock, a separate steam cracker feed can be passed into a steam cracking reactor to form a steam cracker reactor effluent. At least a portion of the steam cracker reactor effluent can be passed into a primary fractionator to form at least a first fractionator product and one or more additional fractionator products having a higher boiling range than the first fractionator product. At least a portion of the first fractionator product and at least a portion of the pyrolysis product fraction can be passed into a process gas compressor to form a compressed olefin product fraction. The volume of the pyrolysis product fraction can correspond to 0.1 vol % to 20 vol % of a combined volume of the at least a portion of the first fractionator product and the pyrolysis product fraction. The method can further include separating at least a first product stream comprising ethylene and a second product stream comprising propylene from the compressed olefin product fraction.

In various aspects, an integrated system for performing polyolefin pyrolysis and steam cracking is provided. The system can include a polyolefin processing stage for forming a polyolefin feedstock. The system can further include a pyrolysis reactor comprising a pyrolysis inlet and a pyrolysis outlet. The pyrolysis inlet can be in fluid communication with the polyolefin processing stage. The system can further include a first separation stage comprising a first separation stage inlet, a first vapor outlet and a first solids outlet. The first separation stage inlet can be in fluid communication with the pyrolysis outlet. The system can further include a pyrolysis quench stage in fluid communication with the first vapor outlet. The system can further include a second separation stage comprising a second separation stage inlet, a second light outlet, and a second heavy outlet. The second separation stage inlet can be in fluid communication with the pyrolysis quench stage. The system can further include a steam cracking reactor comprising a reactor outlet. The system can further include a primary fractionator comprising one or more fractionator inlets and a plurality of fractionator outlets. The one or more fractionator inlets can be in fluid communication with the reactor outlet and the second heavy outlet. The system can further include at least one quench tower comprising one or more quench tower inlets and one or more quench tower outlets. The at least one quench tower inlet can be in fluid communication with at least one fractionator outlet and the second heavy outlet. The system can further include a process gas compressor comprising a compressor inlet and a compressor outlet. The compressor inlet can be in fluid communication with the one or more quench tower outlets. Additionally, the system can include a plurality of olefin separation stages comprising at least an ethylene outlet and a propylene outlet. The plurality of olefin separation stages can be in fluid communication with the compressor outlet.

DETAILED DESCRIPTION

Figure 1:
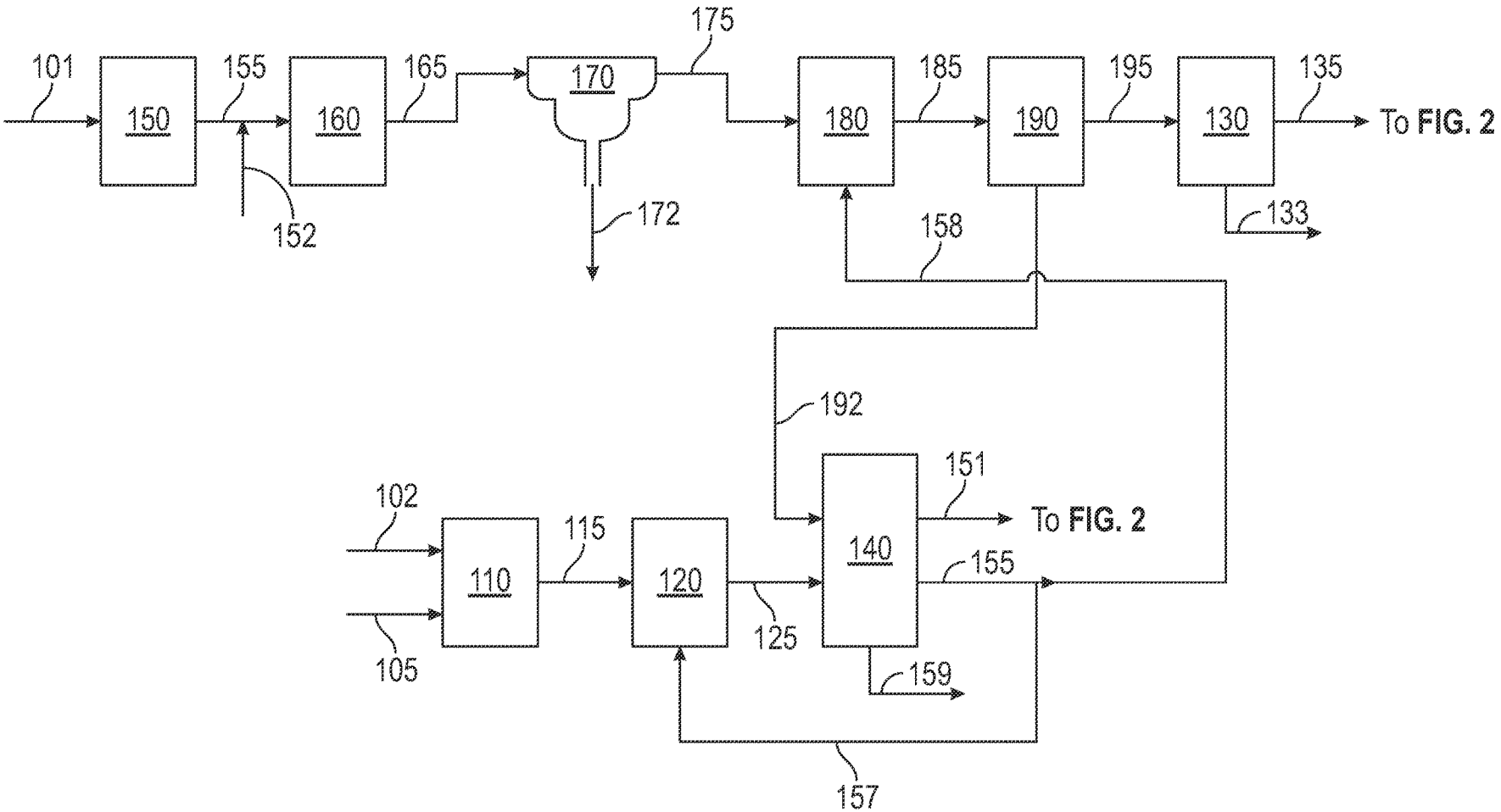
FIG. 1 shows an example of a portion of a process train for pyrolysis of various feedstocks.

All numerical values within the detailed description and the claims herein are modified by "about" or "approximately" the indicated value, and take into account experimental error and variations that would be expected by a person having ordinary skill in the art.

In various aspects, systems and methods are provided for integration of a reactor for polyolefin pyrolysis with the effluent processing train for a steam cracker. The polyolefins can correspond to, for example, polyolefins in plastic waste. Integrating a process for polyolefin pyrolysis with a steam cracker processing train can allow a mixture of polymers to be converted to monomer units while reducing or minimizing costs and/or equipment footprint. This can allow for direct conversion of polyolefins to the light olefin monomers in high yield while significantly lowering capital and energy usage due to integration with a steam cracking process train. The integration can be enabled in part by selecting feeds with appropriate mixtures of various polymer types and/or by limiting the volume of the plastic waste pyrolysis product relative to the volume from the steam cracker(s) in the steam cracking process train. By selecting plastic waste and/or other polyolefin sources with an appropriate mixture of polyolefins as the feedstock, the resulting polyolefin pyrolysis product can be separated in a steam cracking process train to produce separate fractions for various polymer grade light olefin products.

In addition to selecting an appropriate feed envelope, integration of polyolefin pyrolysis with a steam cracker processing train can be further enabled by including one or more contaminant removal stages. The contaminant removal stages can be located prior to the steam cracking processing train and/or within the steam cracking processing train. The contaminant removal stages can include, but are not limited to, guard beds to trap contaminants and wash stages, such as acidic and/or basic wash stages. For example, a guard bed can be included or added to the steam cracking process train to handle silicon which can be present within some polymer formulations.

Polyolefin polymers are commonly used in a wide variety of industrial and consumer applications. In some instances, substantial quantities of polymer/plastic waste may be available that correspond to a single type of polyolefin, but more typically polyolefin waste corresponds to a mixture of polyethylene, polypropylene, and/or other polymer chains based on small olefins.

Polyolefins can be pyrolyzed under pyrolysis conditions to form a gas phase pyrolysis product that includes olefin monomers. Although the pyrolysis conditions can modify the selectivity for the olefin monomers, the pyrolysis reaction generates a mixture of olefin monomers. This can correspond to a mixture including $C_2$-$C_4$ olefins, a mixture including $C_2$-$C_3$ olefins, or a mixture including $C_2$ olefins, $C_3$ olefins, optionally $C_4$ olefins, and one or more additional olefins (such as $C_5$ or $C_6$ olefins). Due to the cost and complexity of separating the various types of olefin monomers, plastic waste pyrolysis is typically used instead for forming liquid fuels and/or for producing heat to generate electricity. However, it would be desirable to be able to form polymer-grade olefin fractions from plastic waste/polyolefin pyrolysis, as the ethylene and/or propylene monomer yields from pyrolysis of polyolefins can be higher than the yields of ethylene and/or propylene from steam cracking of a crude fraction. For example, the yield of ethylene plus propylene monomers from pyrolysis of mixed polyolefin polymers can be 45 wt % or more, or 50 wt % or more, such as up to 65 wt %, relative to a weight of polyolefins in the feedstock. This is roughly comparable to the olefin yield from steam cracking of naphtha. This is unexpected, as olefin yields from steam cracking are typically inversely related to the boiling range and/or molecular weight of the feed used for steam cracking, until the point where the feed includes too many components boiling above the vacuum gas oil range and/or includes too many components with low ratios of hydrogen to carbon. For example, steam cracking of typical crude fractions typically results in an ethylene plus propylene yield of roughly 30 wt % to 40 wt % relative to the weight of the feed. Without being bound by any particular theory, the increased yield of ethylene and/or propylene monomers from pyrolysis of polyolefin polymers, relative to pyrolysis of a liquid crude oil fraction, can be due in part to the increased amount of paraffinic compounds in a feed including polyolefin polymers.

In an integrated process, at least a portion of the ethylene and/or propylene produced by the steam cracking process train can correspond to ethylene and/or propylene generated by pyrolysis of polyolefins (such as polyolefins from plastic waste). The amount of ethylene and/or propylene that is derived from polyolefin pyrolysis can be determined in any convenient manner, such as by mass balance. For example, a first processing run could be performed where the only effluent passed into the steam cracking process train is the effluent from the corresponding steam cracking reactor(s). A second processing run could then be performed where the effluent from the steam cracking reactor(s) is held constant while an additional effluent from a pyrolysis reactor is added to the steam cracking process train at a suitable location. The resulting difference in ethylene and/or propylene yield can correspond to the additional yield from the polyolefin pyrolysis process.

Steam cracking is a type of pyrolysis process that can be used to convert various types of petroleum feeds and/or crude fractions to form olefinic products. Conventionally, steam cracking is not considered a suitable method for processing of polymer/plastic waste. A steam cracker includes a convection section and a radiant section. During steam cracking, feeds are pre-heated in the convection section. The majority of cracking occurs in the radiant section, where the temperatures are 800° C. or more, but the residence time is only a few milliseconds. In order to reduce or minimize fouling in the cracking section due to coke formation, steam cracker feed is vaporized prior to entering the radiant section. Additionally, to facilitate vaporizing the feed prior to entering the radiant section, heavy feeds to a steam cracker are separated to remove a bottoms fraction prior to being exposed to the pyrolysis conditions. As a result, steam cracker feeds typically have a T95 boiling point of 450° C. or less. By contrast, mixed polyolefin waste can correspond to polymers with boiling points well above 500° C., based on the polymer chain length. Even if such polyolefins were not removed by a separation, such polyolefins would lead to rapid fouling of a steam cracker, due to the inability to vaporize the polyolefins under the conditions in either the convection zone or the radiant zone.

In some aspects, steam cracking can be performed on a feed substantially composed of light ($C_2$-$C_4$) hydrocarbons, such as ethane steam cracking. Such steam cracking of light hydrocarbons can generate yields of ethylene and/or propylene on the order of 70%. However, it is not always feasible to provide sufficient quantities of light hydrocarbon feeds to provide olefins for industrial scale polymer production. Thus, steam cracking is also used to process crude fractions and/or other liquid feeds.

In such aspects where the feed for steam cracking corresponds to a liquid feed, fractionation of the steam cracker products is typically performed to separate out higher and lower value portions of the steam cracker products. For example, in addition to light olefins, products from steam cracking of a liquid feed (such as a crude fraction) can include steam cracker naphtha, steam cracker gas oil, and steam cracker tar. With regard to the light olefins, additional separation stages can be used to separate $C_2$, $C_3$, and $C_4$ olefins within the light olefin product. In this discussion, a liquid feed for steam cracking refers to a feed that is at least partially liquid at 20° C. and 100 kPa-a.

It has been discovered that the product recovery and separation stages of a steam cracker processing train can be used to process limited amounts pyrolysis effluent from a plastic waste/polyolefin pyrolysis process. By integrating a plastic waste/polyolefin pyrolysis process with a steam cracking process, the amount of additional separation equipment needed for the pyrolysis process can be reduced or minimized, while still allowing separation of the light olefin monomers into ethylene, propylene, and/or other monomers present in a plastic waste mixture.

In this discussion, a reference to a "$C_x$" fraction, stream, portion, feed, or other quantity is defined as a fraction (or other quantity) where 50 wt % or more of the fraction corresponds to hydrocarbons having "x" number of carbons. When a range is specified, such as "$C_x$-$C_y$", 50 wt % or more of the fraction corresponds to hydrocarbons having a number of carbons between "x" and "y". A specification of "$C_{x+}$" (or "$C_{x-}$") corresponds to a fraction where 50 wt % or more of the fraction corresponds to hydrocarbons having the specified number of carbons or more (or the specified number of carbons or less).

Polyolefin Feedstock

In various aspects, when integrating a plastic waste/polyolefin pyrolysis process with a steam cracking processing train, the feedstock for pyrolysis can include or consist essentially of one or more polyolefin polymers. The systems and methods described herein can be suitable for processing plastic waste corresponding to a single type of olefinic polymer. However, additional benefits can be realized when the plastic feedstock contains polymers including a plurality of monomer types. In aspects where the feedstock consists essentially of polyolefin polymers, the feedstock can include polyolefin polymers as well as any additives, modifiers, packaging dyes, and/or other components typically added to a polymer during and/or after formulation. The feedstock can further include any components typically found in polymer waste. Finally, the feedstock can further include one or more solvents or carriers so that the feedstock to the pyrolysis process corresponds to a solution or slurry of the polyolefin polymers.

The polyolefin feedstock can include at least one of polyethylene and polypropylene. The polyethylene can correspond to any convenient type of polyethylene, such as high density or low density versions of polyethylene. Similarly, any convenient type of polypropylene can be used. In addition to polyethylene and/or polypropylene, the plastic feedstock can optionally include one or more of polystyrene, polyvinylchloride, polyamide (e.g., nylon), polyethylene terephthalate, and ethylene vinyl acetate. Still other polyolefins can correspond to polymers (including co-polymers) of butadiene, isoprene, and isobutylene. In some aspects, the polyethylene and polypropylene can be present in the mixture as a co-polymer of ethylene and propylene. More generally, the polyolefins can include co-polymers of various olefins, such as ethylene, propylene, butenes, hexenes, and/or any other olefins suitable for polymerization.

In this discussion, unless otherwise specified, weights of polyolefin polymers in a feedstock correspond to weights relative to the total polymer content in the feedstock. Any additives/modifiers/other components included in a formulated polymer are included in this weight. However, the weight percentages described herein exclude any solvents or carriers used so that the feedstock corresponds to a solution or slurry of polymers. For compatibility with introducing the plastic pyrolysis product in a steam cracking process train, the feedstock can include limited amounts of polymers different from polyethylene and/or polypropylene. In various aspects, the plastic feedstock for pyrolysis can include 55 wt % to 100 wt % of polyethylene, polypropylene, copolymer of ethylene and propylene, other $C_4$-$C_6$ olefins and/or dienes, or a combination thereof. In aspects where the feedstock corresponds to 95 wt % or more of polymers derived from ethylene and propylene, the feedstock can preferably include 10 wt % of more of ethylene monomers and 10 wt % or more of propylene monomers.

In aspects where the plastic feedstock includes less than 100 wt % of polyethylene and/or polypropylene, the plastic feedstock can optionally include 0.1 wt % or more of other polymers. For example, in some aspects the plastic feedstock can include 0.1 wt % to 35 wt % of polystyrene, or 1.0 wt % to 35 wt %, or 0.1 wt % to 20 wt %, or 1.0 wt % to 20 wt %, or 10 wt % to 35 wt %, or 5 wt % to 20 wt %. Including polystyrene in the feed can increase the yield of aromatics, including the yield of styrene. In some aspects, styrene can be isolated and used for production of polystyrene. Additionally or alternately, styrene can be blended with steam cracked naphtha that is generated by the steam cracking process. It is noted that as the amount of polystyrene is increased, the yield of ethylene and/or propylene monomers can decrease. Limiting the amount of polystyrene can allow for production of ethylene and/or propylene from the polyethylene/polypropylene in the plastic feedstock in amounts that are greater than conventional steam cracker yields. Additionally, polystyrene can potentially be recycled by processing at lower temperatures, such as around 450° C., to convert polystyrene into styrene monomers. Thus, limiting polystyrene content in the polyolefin feed can also be beneficial in order to allow polystyrene to be processed under more favorable conditions.

In some aspects, the plastic feedstock can optionally include 0.1 wt % to 10 wt %, or 0.1 wt % to 2.0 wt %, or 0.1 wt % to 1.0 wt % of polyvinyl chloride, polyvinylidene chloride, or a combination thereof; and/or 0.1 wt % to 1.0 wt % polyamide. Polyvinyl chloride is roughly 65% chlorine by weight. As a result, pyrolysis of polyvinyl chloride (and/or polyvinylidene chloride) can result in formation of substantial amounts of hydrochloric acid relative to the initial weight of the polyvinyl chloride. In limited amounts, the hydrochloric acid that results from pyrolysis of polyvinyl chloride and/or polyvinylidene chloride can be removed using guard beds prior to allowing the pyrolysis product to enter the steam cracking process train. With regard to polyamide, pyrolysis results in formation of NON. Limited amounts of NO can be handled by the steam cracking process train. In other aspects, from 0.1 wt % to 10 wt % of polyvinyl chloride and/or polyvinylidene chloride can optionally be included in the feed by including additional chlorine removal stages prior to combining the polyolefin pyrolysis product with the steam cracking processing train.

In some aspects, the plastic feedstock can optionally include 0.1 wt % to 10 wt % polyethylene terephthalate, or 1.0 wt % to 10 wt %. Additionally or alternately, the plastic feedstock can optionally include 0.1 wt % to 10 wt % of ethylene vinyl acetate, or 1.0 wt % to 10 wt %. Both polyethylene terephthalate and ethylene vinyl acetate can depress yields of ethylene and/or propylene monomers, while potentially also increasing production of CO, $CO_2$, or a combination thereof. Limiting the amount of polyethylene terephthalate and/or ethylene vinyl acetate can allow for production of ethylene and/or propylene from the polyethylene/polypropylene in the plastic feedstock in amounts that are greater than conventional steam cracker yields.

In various aspects, the polyolefins can be prepared for incorporation into the plastic feedstock. Methods for preparing the polyolefins can include reducing the particle size of the polyolefins and mixing the polyolefins with a solvent or carrier.

In aspects where the polymer waste/polyolefins are introduced into the pyrolysis reactor at least partially as solids, having a small particle size can facilitate transport of the solids into the pyrolysis reactor. Smaller particle size can potentially also contribute to achieving a desired level of conversion of the polymers/polyolefins under the short residence time conditions of the pyrolysis. To prepare solids for pyrolysis, the solid polymers/polyolefins can be crushed, chopped, ground, or otherwise physically processed to reduce the median particle size to 3.0 cm or less, or 2.5 cm or less, or 2.0 cm or less, or 1.0 cm or less, such as down to 0.01 cm or possibly still smaller. For determining a median particle size, the particle size is defined as the diameter of the smallest bounding sphere that contains the particle.

Additionally or alternately, a solvent or carrier can be added to the feedstock. For introduction into a pyrolysis reactor, it can be convenient for the polymer waste/polyolefins to be in the form of a solution, slurry, or other fluid-type phase. If a solvent is used to at least partially solvate the polyolefins, any convenient solvent can be used. Examples of suitable solvents can include (but are not limited to) a wide range of petroleum or petrochemical products. For example, some suitable solvents include crude oil, naphtha, kerosene, diesel, and gas oils. Other potential solvents can correspond to naphthenic and/or aromatics solvents, such as toluene, benzene, methylnaphthalene, cyclohexane, methylcyclohexane, and mineral oil. Still other solvents can correspond to refinery fractions, such as a gas oil fraction or naphtha fraction from a steam cracker product. If a carrier is used, the carrier can correspond to a liquid or gas phase carrier, such as steam.

Processing Conditions—Polyolefin Pyrolysis

In various aspects, the polyolefin waste is first prepared by cutting the polyolefins into small particles and/or by dissolving the polyolefins in a solvent. The prepared feedstock can then be fed into a suitable reactor, such as a fluidized bed thermal cracker. The feedstock is then heated to a temperature between 500° C.-900° C. for a reaction time to perform pyrolysis. The temperature can depend in part on the desired products. Higher temperatures can increase selectivity for ethylene, while lower temperatures can increase selectivity for propylene. The reaction time where the feedstock is maintained at or above 500° C. can be limited in order to reduce or minimize formation of coke. In some aspects, the reaction time can correspond to 0.1 seconds to 6.0 seconds, or 0.1 seconds to 5.0 seconds, or 0.1 seconds to 1.0 seconds, or 1.0 seconds to 6.0 seconds, or 1.0 seconds to 5.0 seconds. The pyrolyzed feedstock is cooled to below 500° C. at the end of the reaction time.

In some aspects, a diluent steam can also be fed into the pyrolysis reactor to control olefin partial pressure and to improve ethylene and propylene yields. The steam also serves as a fluidizing gas. The weight ratio of steam to feedstock can be between 0.3:1 to 10:1.

The heating and cooling of the feedstock/pyrolysis products can be performed in any convenient manner that allows for rapid heating of the feedstock. In some aspects, at least a portion of the heating of the feedstock to the pyrolysis temperature can be performed at a heating rate of 100° C. per second or more, or 200° C. per second or more, such as up to 1,000° C. per second or possibly still faster. As an example, in an aspect where the pyrolysis reactor corresponds to a fluidized bed, the heating of the feedstock can be performed by mixing the feedstock with heated fluidizing particles. Sand is an example of a suitable type of particle for the fluidized bed. During operation, sand (or another type of heat transfer particle) can be passed into a regenerator to burn off coke and heat the particles. Additional heat will have to be supplied in the regenerator to compensate for the low coke make in this process. The heated particles can then be mixed with the feedstock prior to entering the reactor. By heating the heat transfer particles to a temperature above the desired pyrolysis temperature, the heat transfer particles can provide at least a portion of the heat needed to achieve the pyrolysis temperature. For example, the heat transfer particles can be heated to a temperature that is greater than the desired pyrolysis temperature by 100° C. or more. Optionally, if the feedstock, sand, and fluidizing steam does not provide sufficient material to form a fluidized bed, additional fluidizing gas can be added, such as additional nitrogen, but this also will cause a corresponding increase in the volume of gas flow that needs to be handled during product recovery. After exiting from the pyrolysis reactor, the heat transfer particles can be separated from the vapor portions of the pyrolyzed effluent using a cyclone or another solid/vapor separator. Such a separator can also remove any other solids present after pyrolysis. It is noted that separation using a cyclone separator can result in an increase in $N_2$ in the steam cracker effluent, which can make product recovery more challenging. Optionally, in addition to a cyclone or other primary solid/vapor separator, one or more filters can be included at a location downstream from the cyclone to allow for removal of fine particles that become entrained in the vapor phase.

One of the difficulties with polyolefin pyrolysis can be handling chlorine that is evolved during pyrolysis, such as chlorine derived from pyrolysis of polyvinyl chloride and/or polyvinylidene chloride. In some aspects, the production of chlorine in the pyrolysis reactor can be mitigated by including a calcium source in the heat transfer particles, such as including calcium oxide particles. Within the pyrolysis environment, calcium oxide can react with chlorine generated during pyrolysis to form calcium chloride. This calcium chloride can then be purged from the system as part of a purge stream for the heat transfer particles. A corresponding make-up stream of fresh heat transfer particles can be introduced to maintain a desired amount of the heat transfer particles in the polyolefin pyrolysis stage.

After removing solids, the products can be cooled using a heat exchanger (or another convenient method) to a temperature of 300° C. to 400° C. to stop the reaction and recover the heat. Further quenching can then be performed, such as quenching using a liquid stream from the primary fractionator of the steam cracker. An example of a quench stream can be a highly aromatic liquid, such as a gas oil fraction generated from pyrolysis or steam cracking (e.g., steam cracked gas oil). The combination of quenching and/or other cooling can be sufficient to cause the $C_{5+}$ portion of the products to become a liquid, to facilitate separation.

The cooled stream can then be sent to a liquid vapor separator to separate the $C_{5+}$ liquid and any quench oil from the remaining $C_{4-}$ portion of the pyrolysis products. The $C_{4-}$ fraction can also include any gas phase oxides generated during pyrolysis (e.g., CON, NON, $SO_x$). The liquid stream(s) can be sent to the primary fractionator of the steam cracker. The $C_{4-}$ gas stream can be sent to a secondary quench tower. The $C_{4-}$ stream is washed with water in the quench tower, and then dried to remove the water. The remaining portion of the washed and dried $C_{4-}$ gas stream is then passed through one or more guard beds for contaminant removal prior to sending the remaining portion of the washed and dried $C_{4-}$ gas stream to the inlet of the process gas compressor of a steam cracker process train. In the steam cracker process train, the remaining portion of the washed and dried $C_{4-}$ gas stream it is combined with the gas products from the steam cracker. Using a secondary quench tower on the polyolefin pyrolysis gas phase product can reduce or minimize the amount of flow that is passed through guard beds for removal of chlorine. Alternatively, if the $C_{4-}$ gas stream is substantially free of contaminants such as chlorine (i.e., contaminants not normally present in a steam cracker product), the $C_{4-}$ gas stream can be passed into a quench tower that is part of the steam cracker process train, and/or the $C_{4-}$ gas stream can be introduced at another location, such as in the primary fractionator or the process gas compressor.

In various aspects, the volume of the $C_{4-}$ gas stream can correspond to a minor portion of the total flow into the process gas compressor and/or the olefin separation stages. For example, the volume of the $C_{4-}$ gas stream can correspond to 0.1 vol % to 20 vol % of the gas flow in the process gas compressor, or 0.1 vol % to 10 vol %, or 1.0 vol % to 20 vol %, or 5.0 vol % to 20 vol %, or 1.0 vol % to 10 vol %, relative to the combined volume of the $C_{4-}$ gas flow and the gas flow provided to the process gas compressor from the steam cracker products.

The combined gas products from polymer pyrolysis and steam cracking are separated by processing them through a series of refrigeration, compression and distillation steps. In some aspects, this can allow for formation of polymer grade ethylene, propylene, isobutylene, butenes and butadiene with at least 99.9% purity. To achieve this purity, the separation steps can include steps to separate ethane from ethylene, propane from propylene, and butane and/or butene from butadiene.

Processing Conditions—Steam Cracking

Steam cracking is a type of a pyrolysis process. In various aspects, the feed for steam cracking can correspond to any type of liquid feed (i.e., feed that is liquid at 20° C. and 100 kPa-a, as defined herein). Examples of suitable reactor feeds can include whole and partial crudes, naphtha boiling feeds, distillate boiling range feeds, resid boiling range feeds (atmospheric or vacuum), or combinations thereof. Additionally or alternately, a suitable feed can have a T10 distillation point of 100° C. or more, or 200° C. or more, or 300° C. or more, or 400° C. or more, and/or a suitable feed can have a T95 distillation point of 450° C. or less, or 400° C. or less, or 300° C. or less, or 200° C. or less. It is noted that the feed for steam cracking can be fractionated to remove a bottoms portion prior to performing steam cracking so that the feed entering the reactor has a T95 distillation point of 450° C. or less. The distillation boiling range of a feed can be determined, for example, according to ASTM D2887. If for some reason ASTM D2887 is not suitable, ASTM D7169 can be used instead. Although certain aspects of the invention are described with reference to particular feeds, e.g., feeds having a defined T95 distillation point, the invention is not limited thereto, and this description is not meant to exclude other feeds within the broader scope of the invention.

A steam cracking plant typically comprises a furnace facility for producing steam cracking effluent and a recovery facility for removing from the steam cracking effluent a plurality of products and by-products, e.g., light olefin and pyrolysis tar. The furnace facility generally includes a plurality of steam cracking furnaces. Steam cracking furnaces typically include two main sections: a convection section and a radiant section, the radiant section typically containing burners. Flue gas from the radiant section is conveyed out of the radiant section to the convection section. The flue gas flows through the convection section and can then be optionally treated to remove combustion by-products such as NON. Hydrocarbon is introduced into tubular coils (convection coils) located in the convection section. Steam is also introduced into the coils, where it combines with the hydrocarbon to produce a steam cracking feed. The combination of indirect heating by the flue gas and direct heating by the steam leads to vaporization of at least a portion of the steam cracking feed's hydrocarbon component. The steam cracking feed containing the vaporized hydrocarbon component is then transferred from the convection coils to tubular radiant tubes located in the radiant section. Indirect heating of the steam cracking feed in the radiant tubes results in cracking of at least a portion of the steam cracking feed's hydrocarbon component. Steam cracking conditions in the radiant section, can include, e.g., one or more of (i) a temperature in the range of 760° C. to 880° C., (ii) a pressure in the range of from 1.0 to 5.0 bars (absolute), or (iii) a cracking residence time in the range of from 0.10 to 0.5 seconds.

Steam cracking effluent is conducted out of the radiant section and is quenched, typically with water or quench oil. The quenched steam cracking effluent is conducted away from the furnace facility to the recovery facility, for separation and recovery of reacted and unreacted components of the steam cracking feed. The recovery facility typically includes at least one separation stage, e.g., for separating from the quenched effluent one or more of light olefin, steam cracker naphtha, steam cracker gas oil, steam cracker tar, water, light saturated hydrocarbon, and molecular hydrogen.

Steam cracking feed typically comprises hydrocarbon and steam, such as 10.0 wt % or more hydrocarbon, based on the weight of the steam cracking feed, or 25.0 wt % or more, or 50.0 wt % or more, or 65 wt % or more, and possibly up to 80.0 wt % or possibly still higher. Although the hydrocarbon can comprise one or more light hydrocarbons such as methane, ethane, propane, butane etc., it can be particularly advantageous to include a significant amount of higher molecular weight hydrocarbon. Using a feed including higher molecular weight hydrocarbon can decrease feed cost, but can also increase the amount of steam cracker tar in the steam cracking effluent. In some aspects, a suitable steam cracking feed can include 10 wt % or more, or 25.0 wt % or more, or 50.0 wt % or more (based on the weight of the steam cracking feed) of hydrocarbon compounds that are in the liquid and/or solid phase at ambient temperature and atmospheric pressure, such as up to having substantially the entire feed correspond to heavier hydrocarbons.

The hydrocarbon portion of a steam cracking feed can include 10.0 wt % or more, or 50.0 wt % or more, or 90.0 wt % or more (based on the weight of the hydrocarbon) of one or more of naphtha, gas oil, vacuum gas oil, waxy residues, atmospheric residues, residue admixtures, or crude oil, such as up to substantially the entire feed. Such components can include those containing 0.1 wt % or more asphaltenes. When the hydrocarbon includes crude oil and/or one or more fractions thereof, the crude oil is optionally desalted prior to being included in the steam cracking feed. A crude oil fraction can be produced by separating atmospheric pipestill ("APS") bottoms from a crude oil followed by vacuum pipestill ("VPS") treatment of the APS bottoms. One or more vapor-liquid separators can be used upstream of the radiant section, e.g., for separating and conducting away a portion of any non-volatiles in the crude oil or crude oil components. In certain aspects, such a separation stage is integrated with the steam cracker by preheating the crude oil or fraction thereof in the convection section (and optionally by adding of dilution steam), separating a bottoms steam comprising non-volatiles, and then conducting a primarily vapor overhead stream as feed to the radiant section.

Suitable crude oils can include virgin crude oils, such as those rich in polycyclic aromatics. For example, the steam cracking feed's hydrocarbon can include 90.0 wt % or more of one or more crude oils and/or one or more crude oil fractions, such as those obtained from an atmospheric distillation and/or vacuum distillation; waxy residues; atmospheric residues; naphthas contaminated with crude; various residue admixtures; and steam cracker tar.

Contaminant Removal Stages

Addition of portions of the effluent from polyolefin pyrolysis to a steam cracking processing train can optionally be facilitated by addition of contaminant removal stages. In some aspects, one or more contaminant removal stages can be incorporated into the reaction system at locations prior to combining the polyolefin pyrolysis effluent with the steam cracking processing train. Additionally or alternately, one or more contaminant removal stages can be incorporated into the steam cracking process train downstream from where the polyolefin pyrolysis effluent is combined with the steam cracking effluent. A guard bed (or group of guard beds) an example of a type of contaminant removal stage. A water wash, optionally at acidic or basic conditions, is another example of a type of contaminant removal stage.

Polyolefins can include a variety of contaminants that are present in larger quantities than crude oil fractions used as feed for steam cracking. This can include contaminants such as chlorine that are substantially not present in typical crude oil fractions. This can also include contaminants such as oxygen and nitrogen that may be present in elevated amounts in a polyolefin feed. Some contaminants can correspond to components of the underlying polyolefin, such as the chlorine in polyvinyl chloride or the nitrogen in polyamine. Other contaminants can be present due to additives that are included when making a formulated polymer and/or due to packaging, adhesives, and other compounds that become integrated with the polyolefins after formulation. Such additives, packaging, adhesives, and/or other compounds can include additional contaminants such as chlorine, mercury, and/or silicon.

Prior to combining the pyrolysis effluent with the steam cracker processing train and/or after the process gas compressor, one type of contaminant removal can be use of a water wash for chlorine removal. Optionally, the water wash can correspond to an amine wash and/or a caustic wash. Using an amine wash and/or a caustic wash can assist with removal of chlorine as well as other contaminants, such as $CO_2$. Another option for performing an amine wash can be to include amines in the quench oil for the initial quench of pyrolysis and/or steam cracker effluent. This can allow a subsequent water wash to remove chlorine.

Another form of contaminant removal can be achieved based on pH control within the quench tower(s). Based on additives for pH control, at least a portion of any $NH_3$ in the pyrolysis effluent (and/or in the steam cracker effluent) can be converted to ammonia salts. Such salts can then be retained in the quench water and/or removed via separate water wash.

Additionally or alternately, an additional guard bed can be included for removal of CL and/or HCl. In aspects where the polyolefin feed includes 2.0 wt % or less of polyvinyl chloride and/or polyvinylidene chloride, a guard bed for removal of chlorine compounds can be included after the supplemental quench tower. Examples of suitable guard bed particles for chlorine removal include calcium oxide, magnesium oxide, zinc oxide, and combinations thereof. In aspects where higher chlorine amounts are present in a feed, such as up to 10 wt % of polyvinyl chloride and/or polyvinylidene chloride, additional processing of the feed can be performed prior to pyrolysis to remove chlorine. For example, prior to pyrolysis, such a polyolefin feed can be heated to a temperature of 350° C.-450° C. to convert the chlorine to gas phase compounds. The heated feed can then be passed through a guard bed (such as a calcium oxide guard bed) and/or passed through a water wash, caustic scrubber, or amine scrubber to remove a substantial portion of the chlorine from the feed prior to entering the pyrolysis reactor.

Still another type of guard bed can correspond to a guard bed for removal of ammonia. In addition to nitrogen-containing polymers such as polyamines, various types of polymer additives can include nitrogen. In a pyrolysis environment, a portion of this nitrogen can be converted to ammonia. Various types of adsorbents are available for removal of ammonia, such as molecular sieve base adsorbents. Another option can be to have a supplemental quench tower, so that the ammonia can be removed using a water wash prior to combining the pyrolysis effluent with steam cracking effluent. Still further nitrogen removal can be performed by adding a nitrogen adsorbent (such as a molecular sieve suitable for ammonia adsorption) to one or more process gas driers located downstream from the process gas compressor.

In addition to the above contaminant removal stages for use prior to combining pyrolysis effluent with steam cracker product effluent, other contaminant removal stages can be included for processing of the combined effluents. For example, silicon is commonly found in additives used in polymer formulation. After pyrolysis, the silicon typically is separated into a liquid product. A silicon trap can be added to the steam cracking process train to remove silicon from the liquid steam cracker effluent after it exits from the quench tower.

A fixed bed mercury trap can also be included in the steam cracking process train. The elevated temperatures present in a pyrolysis reaction environment can convert any mercury present in the polyolefin feed into elemental mercury. Such elemental mercury can then be removed using a guard bed. It is noted that some guard beds suitable for mercury removal can also be suitable for silicon removal. Examples of such guard beds include guard beds including refractory oxides with transition metals optionally supported on the surface, such as the oxides and metals used in demetallization catalysts or a spent hydrotreating catalysts. Additionally or alternately, separate guard beds can be used for silicon and mercury removal, or separate adsorbents for silicon removal and mercury removal can be included in a single guard bed. Examples of suitable mercury adsorbents and silicon adsorbents can include, but are not limited to, molecular sieves that are suitable for adsorption of mercury and/or silicon.

Other contaminant removal stages can correspond to contaminant removal that may already be present in a steam cracking process train. For example, any nitrogen oxides can accumulate in the cold box as salts, thereby removing the nitrogen oxides from the process gas. The cold box can be washed periodically to remove the accumulated salts formed from the nitrogen oxides. $CO_2$ can be removed using an amine or caustic wash. CO can be removed by methanation of CO at a downstream location. Additional ammonia and/or oxygen removal stages can also be included.

Configuration Examples

Figure 3:
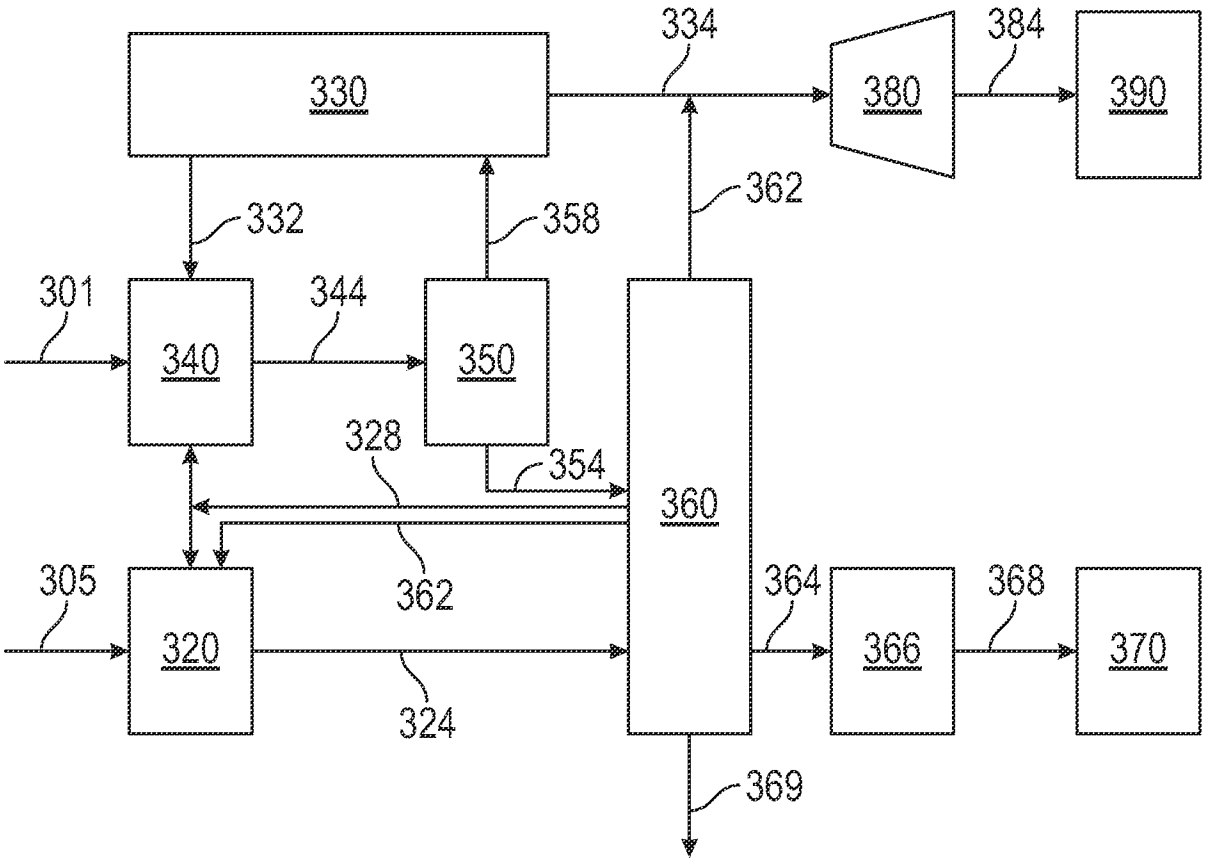
FIG. 3 shows an overview of an example of an integrated process train for pyrolysis of various feedstocks.

FIG. 3 shows an overview of a possible integrated system including both a steam cracking process train and a pyrolysis reactor. In the configuration shown in FIG. 3, a supplemental quench tower is provided to reduce or minimize introduction of contaminants not normally present in a steam cracking process train. In FIG. 3, a feed for steam cracking 305 is introduced into a steam cracking stage 320 along with steam 328 for production of a steam cracker effluent 324. Steam cracking stage 320 includes the steam cracking furnace, an initial feed separator, and one or more quench coolers to cool the steam cracker effluent 324. The quench coolers can use a quench oil 362 as the quench medium. FIG. 3 shows quench oil 362 being returned to the quench coolers in steam cracking stage 320. Optionally but preferably, quench oil 362 can also be returned to quench coolers in polyolefin processing stage 340 (not shown). The steam cracker effluent 324 can be passed into primary fractionator and quench tower stage 360.

FIG. 3 also shows passing a mixed polyolefin feed 301 into a polyolefin processing stage 340. In addition to the pyrolysis reactor, the polyolefin processing stage 340 can include any pre-processing that is needed for the polyolefin feed, such as dissolving the feed in a solvent or chopping the feed to form particles of a desirable size. The polyolefin processing stage 340 can also include a vapor-solids separation stage (such as a cyclone separator) for separating sand and/or catalyst fines from the vapor product, a regenerator, and a quench stage for cooling the resulting pyrolysis effluent. The resulting pyrolysis effluent 344 can be passed into a vapor liquid separator 350. The liquid portion 354 can be passed into primary fractionator and quench tower stage 360. Optionally, at least a portion of liquid portion 354 can instead be returned (not shown) to steam cracking stage 320 to further increase the yield of $C_2$ and/or $C_3$ olefins. The vapor portion 358 can be passed into contaminant removal stage 330. Contaminant removal stage 330 can include, for example, a water wash for chlorine removal and a supplemental quench tower for cooling the vapor portion 358. Additionally or alternately, chlorine removal (such as HCl removal) can be achieved based on control of the pH of the water used in the quench tower. Steam 332 can also be generated by heat exchange and used as an input for polyolefin processing stage 340. The resulting quenched effluent 334 can then be combined with the vapor fraction from primary fractionator and quench tower 360 prior to being passed into process gas compressor 380. The compressed vapor product 384 can then be passed into product recovery stage 390 for further processing and/or separation of the various desired olefin monomers.

In the example shown in FIG. 3, primary fractionator and quench tower 360 can also generate a tar or bottoms fraction 369, a gas oil fraction 362 that can be recycled for use as a quench oil, and a naphtha boiling range fraction 364. The naphtha boiling range fraction can optionally be passed through a contaminant removal stage 366 to form a reduced-contaminant fraction 368. Contaminant removal stage 366 can include, for example, a silicon trap. The reduced-contaminant fraction 368 can then undergo further processing and/or separation 370 to recover desired products, such as a naphtha product and/or a benzene product.

Figure 4:
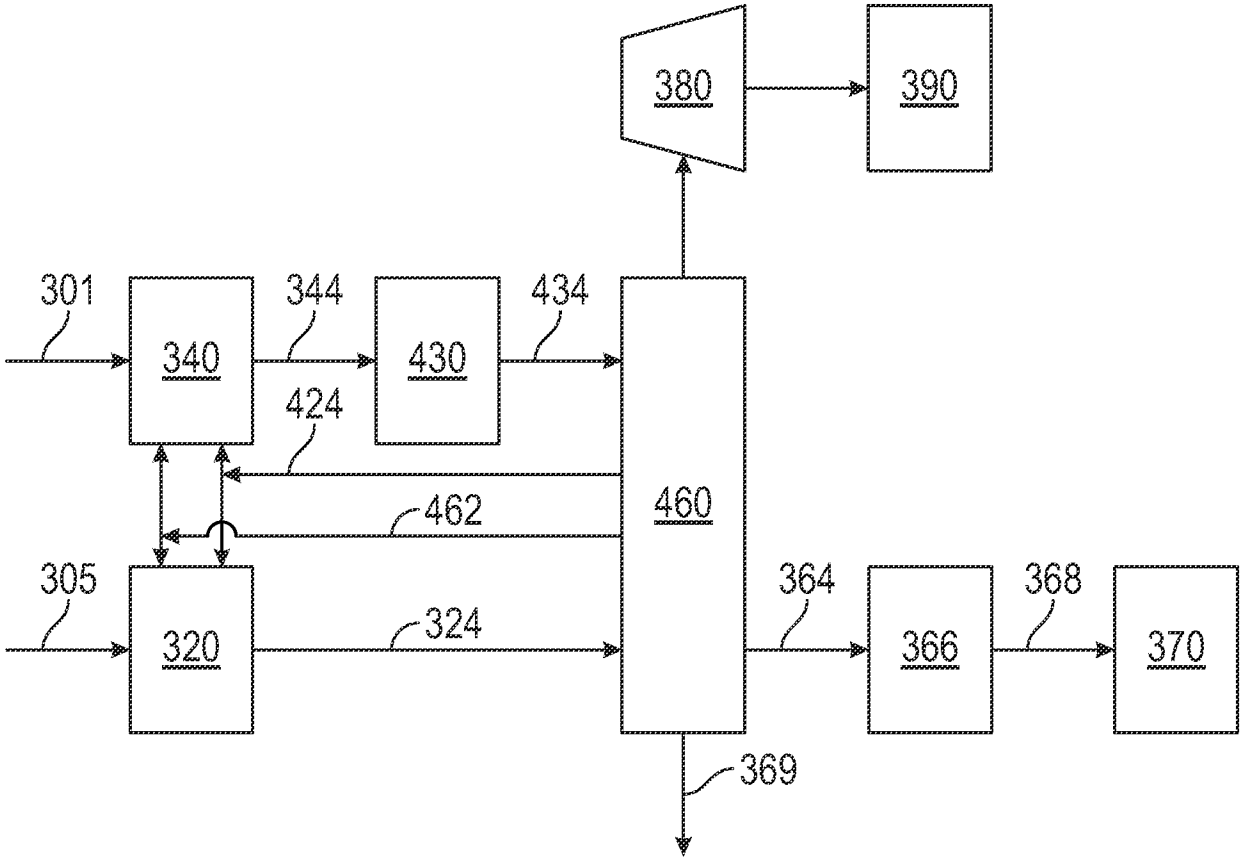
FIG. 4 shows an overview of another example of an integrated process train for pyrolysis of various feedstocks.

FIG. 4 shows another overview example of a configuration for integrating polyolefin pyrolysis with steam cracking. In FIG. 4, instead of including a supplemental quench tower, a contaminant removal stage 430 is used to process pyrolysis effluent 344. This can allow a modified pyrolysis effluent 434 to be passed into primary fractionator and quench tower stage 460 for separation and quenching along with steam cracking effluent 324. The quench oil 462 and steam 424 generated from primary fractionator and quench tower stage 460 can be recycled to both steam cracking stage 320 and polyolefin processing stage 340.

Figure 2:
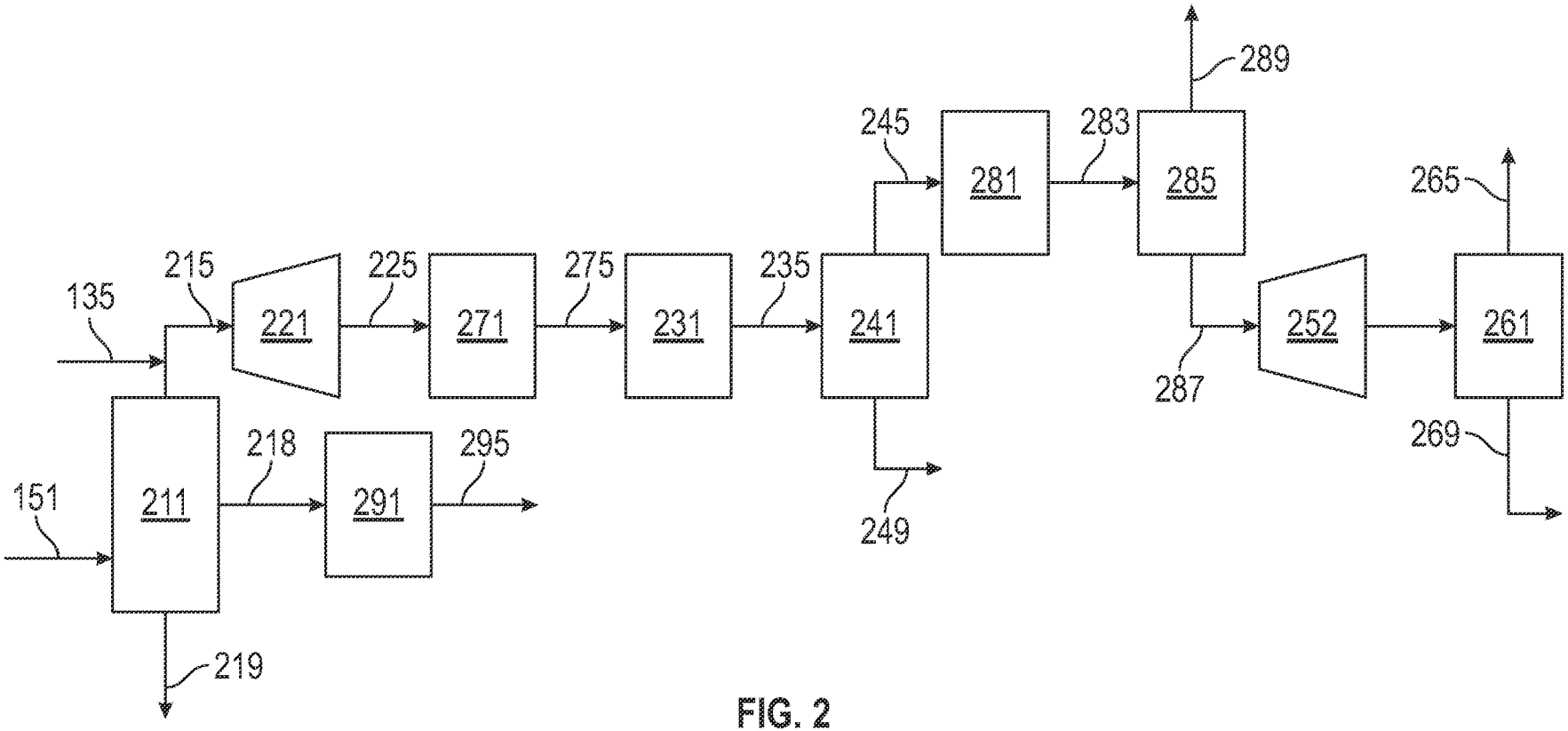
FIG. 2 shows another portion of a process train for pyrolysis of various feedstocks.

FIGS. 1 and 2 show additional details for a configuration that integrates polyolefin pyrolysis with a steam cracking process train. In FIG. 1, a feed for steam cracking 105 is passed into a steam cracking reactor 110. In the example shown in FIG. 1, any optional removal of high molecular weight fractions from the feed 105 has already been performed. Optionally, feed 105 can be combined with steam 102 prior to entering the steam cracking reactor 110. The steam cracking reactor 110 can be operated to produce lower molecular weight hydrocarbons, such as $C_2$-$C_4$ olefins. Under such steam cracking conditions, the steam cracking reactor can also produce various fractions, such as steam cracked naphtha, steam cracker gas oil, and steam cracker tar.

The steam cracker effluent 115 from the steam cracking reactor 110 can then be passed into, for example, a quench stage 120 where the steam cracker effluent 115 is indirectly cooled and/or mixed with water or quench oil (such as optional quench oil 157) to cool the effluent. The quench oil can correspond to, for example, a fraction from the primary fractionator 140, such as a steam cracker gas oil fraction or a bottoms fraction, depending on the configuration. The quenched effluent 125 can then be passed into primary fractionator 140. Optionally, the quenched effluent can be passed through a tar knockout drum or other separator (not shown) for removal of steam cracker tar prior to entering the primary fractionator 140.

In the example shown in FIG. 1, the primary fractionator 140 can generate a bottoms product 159 (such as steam cracker tar), one or more intermediate products 155 (such as quench oil and/or steam cracker gas oil), and an overhead product 151 that includes gas phase components (including olefin monomers) and steam cracker naphtha. A portion of the intermediate products 155 can be used as a quench oil. The overhead product 151 can be further processed, as shown in FIG. 2.

A second feedstock 101 can correspond to a feedstock including polyolefins, such as a feedstock including plastic waste. Feedstock 101 can be passed into a preparation stage 150. In preparation stage 150, the feedstock can be physically processed to reduce the particle size of the polyolefins, mixed with a solvent or carrier, or otherwise processed to produce a prepared stream 155 that can be introduced into pyrolysis reactor 160. Optionally, the prepared stream 155 can be combined with steam 152 prior to entering pyrolysis reactor 160. In some aspects, steam 152 can correspond to steam generated from condensed water by heat exchange at other locations within the reactor train. Optionally, the prepared stream 155 can be combined with a heated, circulating stream of heat transfer particles (not shown) that is returning to reactor 160 from a regenerator (not shown). After pyrolysis of the polyolefin feedstock, the pyrolysis effluent 165 can be passed into a separation stage 170 for separation of solids 172 from the remaining products 175. Such a separator can correspond to, for example, a cyclone separator. The separation stage 170 can further include one or more optional filters for removal of fine particles that remain in the vapor after the cyclone or other primary separator. Optionally, instead of and/or in addition to having one or more filters in separation stage 170, such filter(s) can be located downstream from one or more other stages. The remaining products 175 can then be quenched or cooled 180, optionally using quench oil 158 from fractionator 140. The cooling 180 can be sufficient to allow a vapor liquid separation 190 to be performed on the cooled remaining products 185. The vapor liquid separation 190 can, for example, separate a $C_{5+}$ stream 192 and a $C_{4-}$ product stream 195 from the cooled remaining products 185. The $C_{5+}$ stream can be passed into fractionator 140. The $C_{4-}$ product stream 195 can either be passed into the steam cracker processing train, for example by passing stream 195 into quench tower 211 in FIG. 2, or the $C_{4-}$ product stream 195 can be quenched in a secondary quench tower 130 prior to being passed into the steam cracker process train. In secondary quench tower 130, steam 133 can be removed from the remaining $C_{4-}$ products 135.

The connectivity in FIG. 1 is representative of fluid communication between the various elements. Fluid communication can include direct fluid communication and indirect fluid communication. In FIG. 1, pyrolysis reactor 110 is shown in direct fluid communication with quench stage 120. Pyrolysis reactor 110 is shown in indirect fluid communication with primary fractionator 140 via quench stage 120.

FIG. 2 shows the portion of the steam cracking process train that handles separation of olefin monomers. The fraction 151 and $C_{4-}$ fraction 135 from FIG. 1 can be passed into a quench tower 211. This can remove water 219 while forming a naphtha fraction 218 and a $C_{4-}$ fraction 215. The $C_{4-}$ fraction 135 can, for example, be combined with $C_{4-}$ fraction 215. The naphtha fraction 218 can then be passed into a hydrotreater 291 and/or another type of silicon removal stage to form a naphtha product 295. The $C_{4-}$ fraction 215 can be compressed in a process gas compressor 221. In optional aspects where separate quench towers are used, the overhead fractions from the separate quench towers can be combined prior to and/or within one of the stages of the process gas compressor 221.

In the example shown in FIG. 2, after compression, the compressed stream 225 can be passed through a wash stage 271, such as a water wash, a caustic wash, or an amine wash, to remove $CO_2$, HCl, and/or $NH_3$. The wash stage effluent 275 can then be passed into process gas driers 231. The process gas driers 231 can optionally but preferably include a contaminant removal stage. For example, process gas driers 231 can include a molecular sieve or another type of structure that can serve as a mercury trap. Additionally or alternately, process gas driers 231 can include one or more ammonia removal beds.

The effluent 235 from the process gas driers/contaminant removal 231 can then be separated to form fractions containing the component monomers. In the example shown in FIG. 2, this process can be started by passing effluent 235 into a depropanizer 241. Depropanizer 241 can form a $C_{3+}$ product 249 and a $C_{2-}$ product 245. The $C_{3+}$ product 249 can undergo further separations to allow for recovery of $C_3$ olefins and $C_4$ products. The $C_{2-}$ product 245 can be optionally passed into an acetylene conversion stage 281. After optional acetylene conversion, the acetylene conversion product 283 can be passed into demethanizer stage 285 for conversion of CO to $CH_4$. Demethanizer stage 285 can also include a separator for removal of a stream 289 that includes $CH_4$, CO, $NO_x$ and $H_2$. The remaining stream 287, which includes $C_2$ components, can then be passed into a cold box 252. Cold box 252 can facilitate additional removal of nitrogen oxide compounds prior to separation 261 of $C_2$ olefins 265 from $C_2$ paraffins 269. Any nitrogen oxide compounds accumulated in cold box 252 can be washed out of the system during maintenance events. It is noted that cold box 252 is shown as being between demethanizer stage 285 and separation stage 261 in FIG. 2. In various aspects, cold box 252 can correspond to multiple stages (not shown) used for chilling for product distillation at various locations in the distillation process flow.

ADDITIONAL EMBODIMENTS

Embodiment 1. A method for pyrolyzing a mixed polyolefin feed, comprising: exposing a feedstock comprising a mixture of polyolefins comprising two or more types of monomers to polyolefin pyrolysis conditions to form a pyrolysis effluent, the polyolefin pyrolysis conditions comprising: heating the feedstock at a rate of 100° C. per second or more to form a heated reaction mixture having a temperature of 500° C. to 900° C., and cooling the heated reaction mixture to a temperature of less than 500° C. to form the pyrolysis effluent, the heated reaction mixture being at a temperature of 500° C. or more for 0.1 seconds to 5.0 seconds; performing an initial separation on the pyrolysis effluent to form at least a pyrolysis product fraction and a fraction comprising solid particles; performing steam cracking on a steam cracker feed to form a steam cracker reactor effluent; passing at least a portion of the steam cracker reactor effluent into a primary fractionator to form at least a first fractionator product and one or more additional fractionator products having a higher boiling range than the first fractionator product; passing at least a portion of the first fractionator product and at least a portion of the pyrolysis product fraction into a process gas compressor to form a compressed olefin product fraction, a volume of the pyrolysis product fraction comprising 0.1 vol % to 20 vol % of a combined volume of the at least a portion of the first fractionator product and the pyrolysis product fraction; and separating at least a first product stream comprising ethylene and a second product stream comprising propylene from the compressed olefin product fraction, the first product stream optionally comprising ethylene derived from exposing the feedstock comprising a mixture of polyolefins to the polyolefin pyrolysis conditions, the second product stream optionally comprising propylene derived from exposing the feedstock comprising a mixture of polyolefins to the polyolefin pyrolysis conditions.

Embodiment 2. The method of Embodiment 1, wherein the feedstock comprises 0.1 wt % or more of polyvinyl chloride, polyvinylidene chloride, polyamide, polystyrene, polyethylene terephthalate, ethylene vinyl acetate, or a combination thereof, the feedstock optionally comprising 0.1 wt % to 35 wt % polystyrene.

Embodiment 3. The method of any of the above embodiments, i) wherein the feedstock comprises 0.1 wt % to 10 wt % (or 0.1 wt % to 2.0 wt %) polyvinyl chloride, polyvinylidene chloride, or a combination thereof ii) wherein the feedstock comprises 0.1 wt % to 1.0 wt % polyamide; or iii) a combination of i) and ii), the method optionally further comprising: separating the pyrolysis product fraction to form a lower boiling fraction and a higher boiling fraction; and passing the lower boiling fraction into a contaminant removal stage to form the at least a portion of the pyrolysis product fraction, the at least a portion of the pyrolysis product fraction comprising a lower chlorine content than the lower boiling fraction.

Embodiment 4. The method of any of the above embodiments, wherein the feedstock comprises 0.1 wt % to 10 wt % ethylene vinyl acetate, or wherein the feedstock comprises 0.1 wt % to 10 wt % polyethylene terephthalate, or a combination thereof.

Embodiment 5. The method of any of the above embodiments, wherein the one or more additional fractionator products comprise a naphtha boiling range product, the method further comprising: passing at least a portion of the naphtha boiling range product into a silicon removal stage to form a modified naphtha boiling range product.

Embodiment 6. The method of any of the above embodiments, wherein a) the heated reaction mixture further comprises heat transfer particles, the heat transfer particles optionally comprising calcium oxide, b) the heated reaction mixture further comprises 10 wt % or more of steam, or c) a combination of a) and b).

Embodiment 7. The method of any of the above embodiments, wherein the at least a portion of the first fractionator product and the pyrolysis product fraction are quenched in a quench tower prior to being passed into the product gas compressor; or wherein the at least a portion of the first fractionator product and the pyrolysis product fraction are quenched in separate quench towers prior to being passed into the product gas compressor.

Embodiment 8. The method of any of the above embodiments, further comprising mixing at least one of the pyrolysis effluent and the pyrolysis product fraction with a quench oil.

Embodiment 9. The method of any of the above embodiments, wherein the one or more additional fractionator products comprise a bottoms fraction, a tar fraction, a gas oil fraction, or a combination thereof, the quench oil optionally comprising at least a portion of the gas oil fraction.

Embodiment 10. The method of any of the above embodiments, the method further comprising exposing the compressed olefin product fraction to a water wash, a caustic wash, an amine wash, or a combination thereof, to form a washed compressed olefin product fraction, and passing the washed, compressed olefin product fraction into a contaminant removal stage to form a reduced-contaminant product fraction, wherein separating at least a first product stream comprising ethylene and a second product stream comprising propylene from the compressed olefin product fraction comprises separating the at least a first product stream and a second product stream from the reduced-contaminant product fraction.

Embodiment 11. The method of any of the above embodiments, A) further comprising physically processing a polymer feed to form the feedstock, the mixture of polyolefins comprising particles having a median particle size of 3.0 mm or less; B) further comprising forming the feedstock by combining a polymer feed with a solvent, the mixture of polyolefins being at least partially solvated by the solvent; or C) a combination of A) and B).

Embodiment 12. An integrated system for performing polyolefin pyrolysis and steam cracking, comprising: a polyolefin processing stage for forming a polyolefin feedstock; a pyrolysis reactor comprising a pyrolysis inlet and a pyrolysis outlet, the pyrolysis inlet being in fluid communication with the polyolefin processing stage; a first separation stage comprising a first separation stage inlet, a first vapor outlet and a first solids outlet, the first separation stage inlet being in fluid communication with the pyrolysis outlet; a pyrolysis quench stage in fluid communication with the first vapor outlet; a second separation stage comprising a second separation stage inlet, a second light outlet, and a second heavy outlet, the second separation stage inlet being in fluid communication with the pyrolysis quench stage; a steam cracking reactor comprising a reactor outlet; a primary fractionator comprising one or more fractionator inlets and a plurality of fractionator outlets, the one or more fractionator inlets being in fluid communication with the reactor outlet and the second heavy outlet; at least one quench tower comprising one or more quench tower inlets and one or more quench tower outlets, the at least one quench tower inlet being in fluid communication with at least one fractionator outlet and the second heavy outlet; a process gas compressor comprising a compressor inlet and a compressor outlet, the compressor inlet being in fluid communication with the one or more quench tower outlets; and a plurality of olefin separation stages comprising at least an ethylene outlet and a propylene outlet, the plurality of olefin separation stages being in fluid communication with the compressor outlet.

Embodiment 13. The system of Embodiment 12, wherein the at least one quench tower comprises a common quench tower in fluid communication with the at least one fractionator outlet and the second heavy outlet; or wherein the system further comprises a supplemental quench tower in fluid communication with the second light outlet, wherein the process gas compressor is in fluid communication with the second light outlet via the supplemental quench tower, and wherein the compressor outlet of the process gas compressor is in fluid communication with the plurality of olefin separation stages via one or more contaminant removal stages.

Embodiment 14. The system of Embodiment 12 or 13, wherein the system further comprises a pyrolysis regenerator, the pyrolysis reactor further comprising heat transfer particles, the pyrolysis reactor and the regenerator being in fluid communication for transfer of the heat transfer particles.

Embodiment 15. The system of any of Embodiments 12 to 14, the system further comprising a) a silicon removal stage in fluid communication with the second heavy outlet; b) a silicon removal stage in fluid communication with at least one fractionator outlet of the plurality of fractionator outlets; c) a mercury removal stage in fluid communication with the compressor outlet, the plurality of olefin separation stages being in fluid communication with the compressor outlet via the mercury removal stage; or c) a combination of two or more of a), b, and c).

Supplemental Embodiment A. The method of any of Embodiments 1 to 11, wherein the feedstock is heated at a rate of 200° C. per second or more.

Supplemental Embodiment B. The method of any of Embodiments 1 to 11, wherein the $C_2$ product stream comprises 90 wt % or more ethylene, or wherein the $C_3$ product stream comprises 90 wt % or more propylene, or a combination thereof.

Supplemental Embodiments C. The method of any of Embodiments 1 to 11, wherein at least a second pyrolysis product fraction is separated from the pyrolysis effluent, the method further comprising passing the second pyrolysis product fraction into the primary fractionator.

When numerical lower limits and numerical upper limits are listed herein, ranges from any lower limit to any upper limit are contemplated. While the illustrative embodiments of the disclosure have been described with particularity, it will be understood that various other modifications will be apparent to and can be readily made by those skilled in the art without departing from the spirit and scope of the disclosure. Accordingly, it is not intended that the scope of the claims appended hereto be limited to the examples and descriptions set forth herein but rather that the claims be construed as encompassing all the features of patentable novelty which reside in the present disclosure, including all features which would be treated as equivalents thereof by those skilled in the art to which the disclosure pertains.

The present disclosure has been described above with reference to numerous embodiments and specific examples. Many variations will suggest themselves to those skilled in this art in light of the above detailed description. All such obvious variations are within the full intended scope of the appended claims.

The invention claimed is:

1. A method for pyrolyzing a mixed polyolefin feed, comprising:

exposing a feedstock comprising a mixture of polyolefins comprising two or more types of monomers to polyolefin pyrolysis conditions to form a pyrolysis effluent, the polyolefin pyrolysis conditions comprising:

heating the feedstock at a rate of 100° C. per second or more to form a heated reaction mixture having a temperature of 500° C. to 900° C., and cooling the heated reaction mixture to a temperature of less than 500° C. to form the pyrolysis effluent, the heated reaction mixture being at a temperature of 500° C. or more for 0.1 seconds to 5.0 seconds;

performing an initial separation on the pyrolysis effluent to form at least a pyrolysis product fraction and a fraction comprising solid particles;

performing steam cracking on a steam cracker feed to form a steam cracker reactor effluent;

passing at least a portion of the steam cracker reactor effluent into a primary fractionator to form at least a first fractionator product and one or more additional fractionator products having a higher boiling range than the first fractionator product;

passing at least a portion of the first fractionator product and at least a portion of the pyrolysis product fraction into a process gas compressor to form a compressed olefin product fraction, a volume of the pyrolysis product fraction comprising 0.1 vol % to 20 vol % of a combined volume of the at least a portion of the first fractionator product and the pyrolysis product fraction; and separating at least a first product stream comprising ethylene and a second product stream comprising propylene from the compressed olefin product fraction.

2. The method of claim 1, wherein the feedstock comprises 0.1 wt % or more of polyvinyl chloride, polyvinylidene chloride, polyamide, polystyrene, polyethylene terephthalate, ethylene vinyl acetate, or a combination thereof.

3. The method of claim 1, wherein the feedstock comprises 0.1 wt % to 35 wt % polystyrene.

4. The method of claim 1, i) wherein the feedstock comprises 0.1 wt % to 10 wt % polyvinyl chloride, polyvinylidine chloride, or a combination thereof; ii) wherein the feedstock comprises 0.1 wt % to 1.0 wt % polyamide; or iii) a combination of i) and ii).

5. The method of claim 4, the method further comprising:

separating the pyrolysis product fraction to form a lower boiling fraction and a higher boiling fraction; and passing the lower boiling fraction into a contaminant removal stage to form the at least a portion of the pyrolysis product fraction, the at least a portion of the pyrolysis product fraction comprising a lower chlorine content than the lower boiling fraction.

6. The method of claim 1, wherein the feedstock comprises 0.1 wt % to 10 wt % ethylene vinyl acetate, or wherein the feedstock comprises 0.1 wt % to 10 wt % polyethylene terephthalate, or a combination thereof.

7. The method of claim 1, a) wherein the first product stream comprises ethylene derived from exposing the feedstock comprising a mixture of polyolefins to the polyolefin pyrolysis conditions; b) wherein the second product stream comprises propylene derived from exposing the feedstock comprising a mixture of polyolefins to the polyolefin pyrolysis conditions; or c) a combination of a) and b).

8. The method of claim 1, wherein the one or more additional fractionator products comprise a naphtha boiling range product, the method further comprising:

passing at least a portion of the naphtha boiling range product into a silicon removal stage to form a modified naphtha boiling range product.

9. The method of claim 1, wherein the heated reaction mixture further comprises heat transfer particles, the polyolefin pyrolysis conditions further comprising exposing the feedstock to the heat transfer particles.

10. The method of claim 9, wherein the heat transfer particles comprise calcium oxide, at least a portion of the calcium oxide being converted to calcium chloride under the polyolefin pyrolysis conditions.

11. The method of claim 10, wherein the fraction comprising the solid particles comprises heat transfer particles and calcium chloride, the polyolefin pyrolysis conditions further comprising:

recycling a first portion of the fraction comprising the solid particles to the pyrolysis reactor; and purging a second portion of the fraction comprising the solid particles.

12. The method of claim 1, wherein the heated reaction mixture further comprises 10 wt % or more of steam.

13. The method of claim 1, wherein the feedstock is heated at a rate of 200° C. per second or more.

14. The method of claim 1, wherein the at least a portion of the first fractionator product and the pyrolysis product fraction are quenched in a quench tower prior to being passed into the product gas compressor, or wherein the at least a portion of the first fractionator product and the pyrolysis product fraction are quenched in separate quench towers prior to being passed into the product gas compressor.

15. The method of claim 1, further comprising:

exposing the compressed olefin product fraction to a water wash, a caustic wash, an amine wash, or a combination thereof, to form a washed compressed olefin product fraction, and passing the washed, compressed olefin product fraction into a contaminant removal stage to form a reduced-contaminant product fraction, wherein separating at least a first product stream comprising ethylene and a second product stream comprising propylene from the compressed olefin product fraction comprises separating the at least a first product stream and a second product stream from the reduced-contaminant product fraction.

16. The method of claim 1, wherein the one or more additional fractionator products comprise a bottoms fraction, a tar fraction, or a combination thereof.

17. The method of claim 1, further comprising mixing at least one of the pyrolysis effluent and the pyrolysis product fraction with a quench oil.

18. The method of claim 17, wherein the one or more additional fractionator products comprise a gas oil fraction, the quench oil comprising at least a portion of the gas oil fraction.

19. The method of claim 1, wherein a second pyrolysis product fraction is separated from the pyrolysis effluent, the method further comprising passing the second pyrolysis product fraction into the primary fractionator.

20. The method of claim 1, wherein the first product stream comprises 90 wt % or more ethylene, or wherein the second product stream comprises 90 wt % or more propylene, or a combination thereof.

21. The method of claim 1, further comprising physically processing a polymer feed to form the feedstock, the mixture of polyolefins comprising particles having a median particle size of 3.0 mm or less.

22. The method of claim 1, further comprising forming the feedstock by combining a polymer feed with a solvent, the mixture of polyolefins being at least partially solvated by the solvent.

* * * * *